US012070120B2

(12) United States Patent
Berhault

(10) Patent No.: US 12,070,120 B2
(45) Date of Patent: Aug. 27, 2024

(54) PRODUCT APPLICATOR MEMBER HAVING TWO INTERPOSED TYPES OF APPLICATION ELEMENTS, PACKAGING AND APPLICATION DEVICE COMPRISING SUCH AN APPLICATOR MEMBER, AND METHOD FOR MANUFACTURING SAID APPLICATOR MEMBER

(71) Applicant: L'Oreal, Paris (FR)

(72) Inventor: Alain Berhault, Clichy (FR)

(73) Assignee: L'Oreal, Paris (FR)

( * ) Notice: Subject to any disclaimer, the term of this patent is extended or adjusted under 35 U.S.C. 154(b) by 322 days.

(21) Appl. No.: 17/273,286

(22) PCT Filed: Oct. 15, 2019

(86) PCT No.: PCT/EP2019/077857
§ 371 (c)(1),
(2) Date: Mar. 3, 2021

(87) PCT Pub. No.: WO2020/078943
PCT Pub. Date: Apr. 23, 2020

(65) Prior Publication Data

US 2021/0337960 A1 Nov. 4, 2021

(30) Foreign Application Priority Data

Oct. 17, 2018 (FR) ..... 1859601

(51) Int. Cl.
*A45D 40/26* (2006.01)
*A46B 9/02* (2006.01)
*A46B 9/06* (2006.01)

(52) U.S. Cl.
CPC ..... *A46B 9/021* (2013.01); *A45D 40/265* (2013.01); *A46B 9/06* (2013.01); *A46B 2200/1053* (2013.01)

(58) Field of Classification Search
CPC .... A45D 40/26; A45D 40/262; A45D 40/265; A45D 40/267; A46B 3/06; A46B 3/005;
(Continued)

(56) References Cited

U.S. PATENT DOCUMENTS

2010/0089415 A1* 4/2010 Vandromme ..... A45D 40/262 132/73
2013/0104925 A1* 5/2013 Caulier ..... A46D 1/00 132/218
2014/0153995 A1 6/2014 Lhoyer

FOREIGN PATENT DOCUMENTS

FR 2955018 A1 7/2011

OTHER PUBLICATIONS

International Search Report mailed Jan. 3, 2020, issued in corresponding International Application No. PCT/EP2019/077857, filed Oct. 15, 2019, 2 pages.

* cited by examiner

*Primary Examiner* — Rachel R Steitz
(74) *Attorney, Agent, or Firm* — Christensen O'Connor Johnson Kindness PLLC

(57) ABSTRACT

Applicator member (10) for applying a product to keratin fibres, notably to eyelashes, comprising: —a core (11) made of polymer material, —first application elements (12) that project from the core (11) and are integral with said core (11), and—second application elements (13) that project from the core (11) and are separate from the first application elements (12). Said first and second application elements (12, 13) are arranged in at least two helical coils disposed alternately along the longitudinal axis (X2-X2') of the core (11).

7 Claims, 7 Drawing Sheets

(58) Field of Classification Search
CPC .... A46B 9/021; A46B 9/06; A46B 2200/1053
See application file for complete search history.

PRODUCT APPLICATOR MEMBER HAVING TWO INTERPOSED TYPES OF APPLICATION ELEMENTS, PACKAGING AND APPLICATION DEVICE COMPRISING SUCH AN APPLICATOR MEMBER, AND METHOD FOR MANUFACTURING SAID APPLICATOR MEMBER

The present invention relates to an applicator for applying a cosmetic, makeup or care product to the eyelashes or eyebrows.

The expression "cosmetic product" is understood to mean a product as defined in Regulation (EC) No 1223/2009 of the European Parliament and of the Council of 30 Nov. 2009 relating to cosmetic products.

The invention is particularly suitable for the application of a cosmetic product, such as a makeup product, for example to keratin fibres, and notably for the application of mascara.

Mascara is understood to be a composition intended to be applied to the eyelashes or eyebrows. It may notably be a makeup composition for the eyelashes or eyebrows, a makeup base for the eyelashes, known as "base coat", a composition to be applied over mascara, known as "top coat", or even a composition for the cosmetic treatment of the eyelashes or eyebrows.

Conventionally, an applicator comprises at least one applicator member that defines an application surface intended to come into contact with the part of the body to be treated. The applicator member has a main body or core, of generally elongate shape, which is able to bear application elements that project from said core.

The applicator also comprises a stem which is secured to a gripping member and at the end of which the applicator member is fastened. The gripping member is generally provided to close off, in a sealed manner, the opening of a container containing the cosmetic product to be applied.

Different types of applicator member for eyelashes or eyebrows exist, for example applicator members known as "free fibre" applicator members or those known as "moulded fibre" applicator members.

The "free fibre" applicator members are generally formed by two arms of a metal wire in the form of a U-shaped hairpin, between which there is disposed a set of bristles or free fibres that are independent and arranged substantially alongside one another along the length of the interstitial space between the two arms of the hairpin. A twist force is then applied to the hairpin in order to form a twisted core comprising bristles or free fibres gripped between these arms. The twisting of the arms allows these bristles to spread helically, which bristles take up a distribution in helical layers.

The applicator members known as "moulded fibre" applicator members are obtained at least partially by moulding at least one thermoplastic material, for example an elastomer material, forming a moulded core with spikes.

Also known are applicators known as "hybrid" applicators having a flexible core, for example made of thermoplastic material, bearing spikes, and two hairpin-shaped metal arms that enclose the core and are twisted about one another, imparting a twist to the core and causing the spikes to form helical layers.

In this regard, reference may be made to the documents FR 2 900 318, FR 2 900 319, FR 2 936 691, which at least partially propose applicators of this type.

Also known, from the document FR 2 958 134-A1, is an applicator comprising a core that successively retains by clamping a first applicator member that is formed integrally and has a plurality of applicator elements such as fibres, and a second applicator member having a plurality of bristles.

However, the applicator members are disposed adjacently on the core, distinguishing an eyelash combing zone that is realized by the first applicator member and a zone for loading with product to be applied that is realized by the second applicator member.

It will therefore be appreciated that there is a need to further improve hybrid applicators, and notably to find a compromise between loading with product to be applied and combing/separation of the eyelashes.

The subject of the invention is an applicator member for applying a product to keratin fibres, notably to eyelashes, comprising a core made of polymer material and extending along a longitudinal axis, first application elements that project from the core and are integral or in one piece with said core, and second application elements that are separate from said first application elements and project from the core.

Said first and second application elements are arranged in at least two helical coils disposed alternately along the longitudinal axis of the core.

In other words, an alternation of helical coils of the first and second application elements in the longitudinal direction of the applicator member is obtained.

Thus, an applicator member is provided that has a simple design, is economical and is easy to assemble, with an alternation of the first and second application elements.

Advantageously, a helical coil of the first application elements is disposed between a helical coil of the second application elements.

In order to mould the second application elements on the core, use can be made of any synthetic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA.

The first and the second application elements are separate from one another and have different roles in the application of the product. For example, the first application elements are mainly configured to comb/separate the eyelashes/eyebrows, while the second application elements are mainly configured for loading the product.

The applicator member comprises, for example, a support comprising at least two arms that are twisted at least partially together. The core bearing the first and second application elements is retained between said arms and turns through more than one revolution on itself about its longitudinal axis under the twisting effect brought about by the arms of the support.

The twisting of the arms of the support allows these two types of application elements to spread helically, which elements take up an interposed distribution in helical layers.

Advantageously, before twisting, the core bears two diametrically opposed rows of first application elements and two diametrically opposed rows of second application elements in the form of a layer of second application elements.

In a variant, the core bears four rows, diametrically opposed in pairs, of second application elements in the form of two layers.

Each layer may be curved at the centre of the core.

According to one embodiment, the core is overmoulded on the second application elements. Thus, first and second application elements are obtained that are inseparable from the core so as to form a one-piece application assembly.

According to another embodiment, the core comprises two complementary parts that are connected at one of their ends by material forming a hinge and are preferably hinged between an opened position and a closed position in which the second application elements are pinched between the two parts of the core.

For example, each of the parts of the core bears, on its outer surface, the first application elements.

Advantageously, one of the parts of the core comprises, on an inner surface, a longitudinal rib that extends from the free end of said part towards the hinge and cooperates with a corresponding longitudinal groove in the second part, the groove extending from the free end of said second part towards the hinge.

The second application elements are, for example, disposed in tufts or bunches between the two parts of the core, substantially adjacently to one another, and the core is hinged into the closed position in order to pinch the second application elements between the two complementary parts of the core. Thus, first and second application elements are obtained that are inseparable from the core so as to form a one-piece application assembly.

Provision could be made for the internal surfaces of the two parts to comprise notches configured to make it possible to position the free fibres before the parts are hinged into the closed position. Thus, an alternating arrangement of coils of free fibres and coils of spikes is obtained.

For example, the first application elements are spikes and the second application elements are free fibres or bristles.

The spikes are particularly suitable for combing/separating the eyelashes during the application of the product.

The free fibres are, for example, made of nylon, forming second application elements that are particularly suitable for loading with the product to be applied.

The core may have, in cross section, a shape with at least two diametrically opposed ribs that meet at the centre of the core.

In a variant, the core has, in cross section, a cross shape with four ribs, opposite one another in pairs, that meet at the centre of the core.

At least some of the spikes moulded together with the core, notably all the spikes moulded together with the core, may be multiple spikes, notably double spikes.

A "spike" denotes an individual projecting element.

"Multiple spikes" denotes spikes having at least two arms that extend in divergent directions away from the core, these arms being joined, notably on the core, to one and the same base or having bases that meet or are close to one another. "Bases close to one another" denotes bases the spacing between which is less than their greatest dimension, measured perpendicular to the axis of elongation of the corresponding arm.

The arms of a multiple spike may occupy the same axial position along the longitudinal axis of the core. The longitudinal axes of the arms of the multiple spike may be contained within one plane, perpendicular to the longitudinal axis of the core.

In the case of a double spike, the two arms of the spike may be symmetric to one another with respect to a median plane of symmetry containing the longitudinal axis of the core, when the latter is rectilinear.

The divergent arms of the double spike may form an angle between one another.

The arms of one and the same double spike meet for example at the top of a corresponding rib of the core.

In a variant, at least some of the spikes moulded together with the core are single spikes. The single spikes may be rectilinear and extend radially from the longitudinal axis of the core.

According to a second aspect, the invention relates to a device for packaging and applying a product, notably a makeup product, comprising a container for storing the product, and an applicator comprising an applicator member as described above, which is able to be inserted into the internal volume of the container in order to be loaded with product.

According to a third aspect, the invention relates to a method for manufacturing an applicator member as described above, comprising the following steps:

- forming a one-piece assembly with the core, the first application elements and the second application elements, and
- deforming the core by twisting it about its longitudinal axis to form the two helical coils, and keeping the core in the deformed state.

The present invention will be understood better from studying the detailed description of embodiments that are given by way of entirely non-limiting example and are illustrated by the appended drawings, in which.

Figure 1:
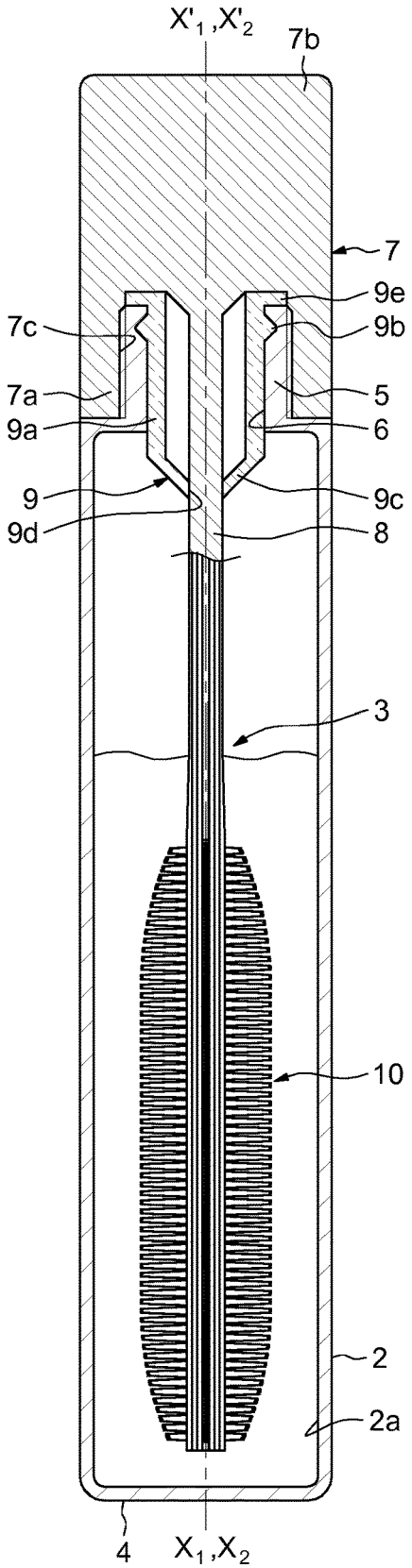
FIG. 1 is a schematic view, in longitudinal section, of a packaging and application device according to the invention.

FIG. 1 shows a device 1 for packaging and applying a product, comprising a container 2 delimiting an internal volume 2*a* containing a product to be applied to a user's eyelashes and/or eyebrows, for example a cosmetic makeup product such as mascara or a care product. The device 1 for packaging and applying a product also comprises an applicator or application device 3 for applying said product.

The container 2 extends along a longitudinal overall axis X1-X1', shown in a position presumed to be vertical. The body of the container 2 is provided with a closed lower end 4 forming a bottom and an upper end 5 forming a neck provided with an opening 7, opposite the lower end 4, allowing access to the internal volume 2*a* containing the product. In a variant, provision could be made for the body of the container not to comprise a neck and for the opening to be made in a free edge of said container.

In the embodiment illustrated, the neck 5 has an outside diameter smaller than the outside diameter of the body of the container 2 and comprises, on its outer surface, a thread 5*a*. The body of the container 2 may be made, for example, of rigid synthetic material.

The application device 3 or applicator extends along a longitudinal overall axis X2-X2', shown in a position presumed to be vertical, that is coincident with the axis X1-X1' in FIG. 1. The application device 3 comprises a gripping member 7, a stem 8, a wiping member or wiper 9 and an applicator member 10.

The gripping member 7 has a tubular mounting skirt 7*a* and a transverse wall 7*b* that extends substantially perpendicularly to the axis X2-X2' and is attached to the mounting skirt 7*a*. The mounting skirt 7*a* comprises a threaded inner surface 7*c* that is intended to be screwed onto the thread 5*a* on the neck of the container 2.

The stem 8 comprises a first end fastened to the applicator member 10 and a second end fastened to the gripping member 7. In the example illustrated, the stem 8 has a circular cross section more or less along its entire length. In a variant, other shapes could be provided for the cross section of the stem, for example a polygonal shape, such as a square or rectangular shape, or even an oval shape, etc.

The stem 8 and the gripping member 7 may be produced in one piece, for example by injection moulding a plastics material, to which the applicator member 10 is then attached. Provision could be made for the stem to be fastened to the gripping member by any other means, for example by adhesive bonding, screwing, etc.

As illustrated in FIG. 1, the wiping member 9 comprises a cylindrical body 9*a* with an outside diameter substantially the same as the inside diameter of the neck 5 of the container 2. The body is delimited by two opposite ends, with one of the ends being in radial contact with the outer surface of the stem 8. The body 9*a* comprises, on its outer surface, a member 9*b* for retaining it on the container 2, for example in the form of an annular bulge that is snap-fitted in a complementary shape on the container 2.

The wiping member 9 also has, at a first free end of the body, an annular wiping lip 9*c*, defining with its free end a wiping orifice 9*d* with a substantially circular cross section. This wiping lip 9*c* extends in the direction of the stem 8 and is dimensioned so as to press at least against the stem 8, or even also against the applicator member 10 as the applicator is removed from the container. The wiping lip 9*c* in this case extends obliquely with respect to the body 9*a* towards the axis X2-X2'.

The inside diameter of the orifice 9*d* is preferably less than or equal to the outside diameter of the stem 8, so as to prevent the product contained in the container 2 from escaping to a space delimited between the stem and the mounting skirt 7*a* of the gripping member 7 of the application device 3.

The body 9*a* of the wiping member 9 comprises, at a second end opposite the first end, an annular flange 9*e* having an outside diameter substantially equal to the inside diameter of the mounting skirt 7*a* of the gripping member 7 of the application device 3. After the application device 3 has been joined to the container 2, the flange 9*e* bears axially against the neck 5 of the container.

The wiping member 9 may be made for example of an elastomer material or a polyolefin, notably polyethylene or any other plastics material. The wiping lip 9*c* is, for example, more flexible than the body 9*a* of the wiping member 9.

Figure 2:
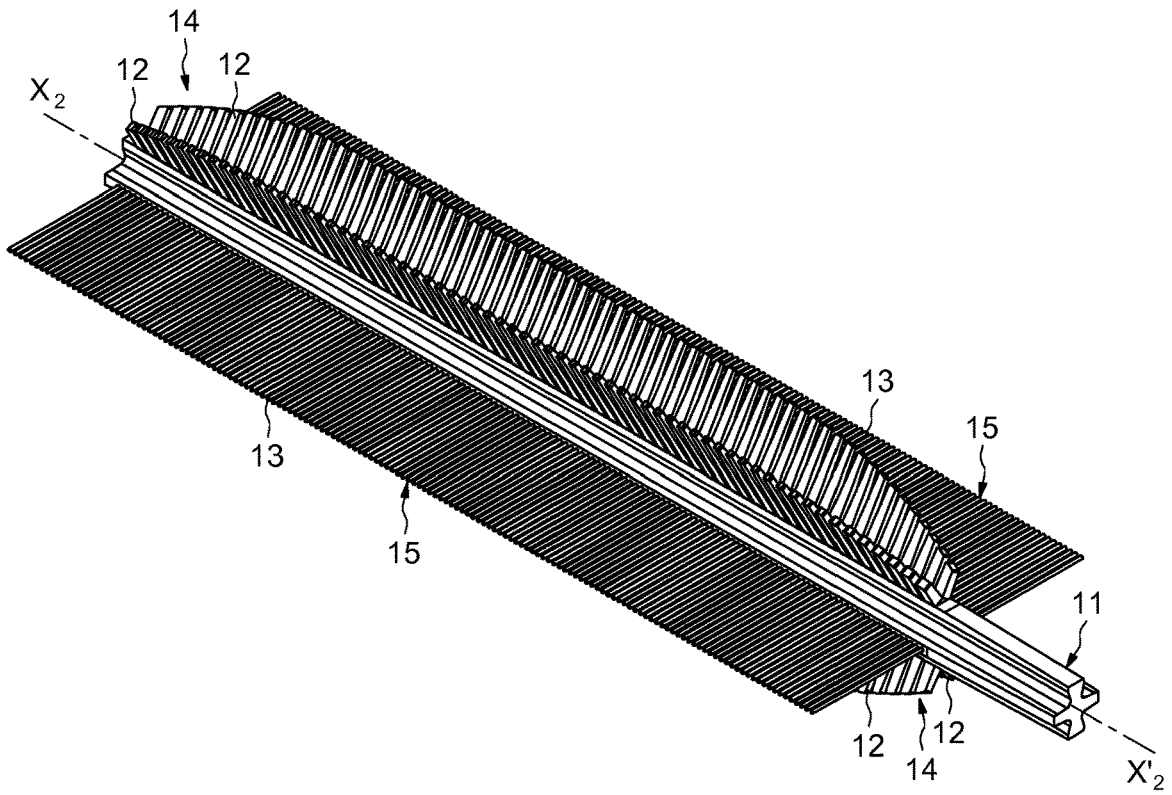
FIG. 2 shows a perspective view, on its own, of the applicator member of the applicator in FIG. 1 according to a first exemplary embodiment of the invention, before the support is fitted on the core.
Figure 3:
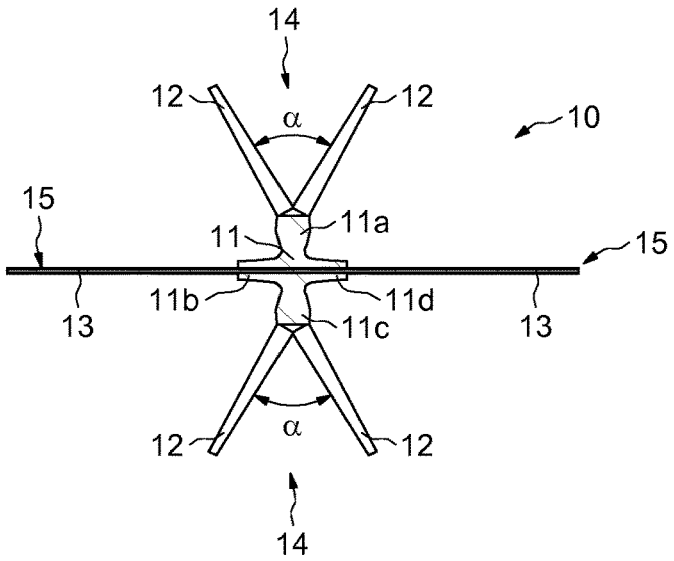
FIG. 3 is a view in section of the applicator member in FIG. 2.
Figure 4:
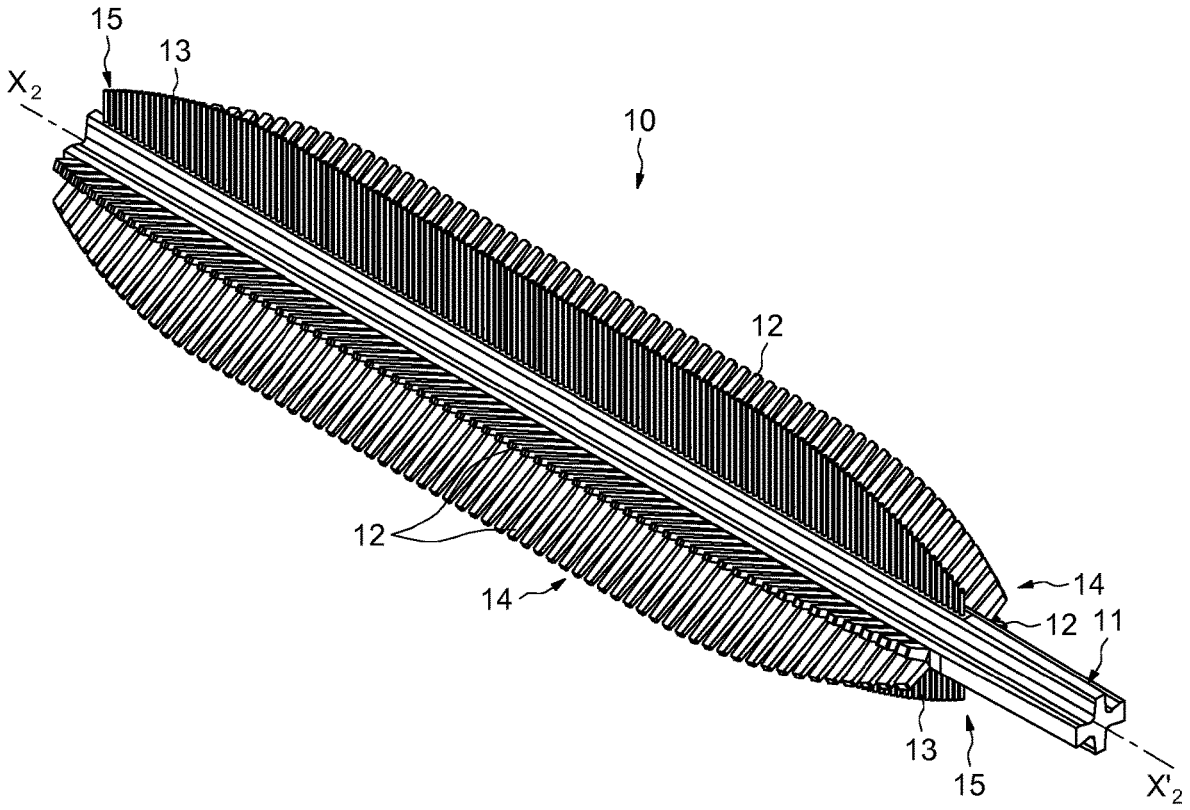
FIG. 4 shows a perspective view, on its own, of the applicator member in FIG. 2 after the application elements have been shaped.

As illustrated in FIGS. 2 to 4, the applicator member 10 has an elongate main body or core 11 extending along the longitudinal overall axis X2-X2', first application elements 12 and second application elements 13.

The core 11 is made of polymer material, notably thermoplastic material, having the first application elements or spikes 12 that are moulded together with the core 11 and extend radially from the core 11 and all around the latter. The spikes 12 may be aligned with one another in at least one row, which extends axially for example along more or less the entire length of the core 11.

A "spike" denotes an individual projecting element.

"Multiple spikes" denotes spikes having at least two arms that extend in divergent directions away from the core, these arms being joined, notably on the core, to one and the same base or having bases that meet or are close to one another. "Bases close to one another" denotes bases the spacing between which is less than their greatest dimension measured perpendicular to the axis of elongation of the corresponding arm.

As can be seen in FIG. 3, the core 11 has, in cross section, a cross shape with four ribs 11*a*, 11*b*, 11*c*, 11*d*, opposite one another in pairs, that meet at the centre of the core 11.

In the example illustrated in FIGS. 2 to 5, the core 11 bears two diametrically opposed rows 14 of double spikes 12. Each double spike 12 has two arms which diverge with increasing distance from the longitudinal axis of the core 11, at an angle $\alpha$, for example equal to 60°. The arms of a single double spike 12 meet at the top of the corresponding rib 11*a*, 11*c* of the core 11. The spikes 12 form first application elements that are particularly suitable for combing/separating the eyelashes during the application of the product.

The core 11 also bears two diametrically opposed rows 15 of free fibres 13 or bristles, made for example of nylon, that form second application elements that are particularly suitable for loading with the product to be applied. The two rows of free fibres 13 form a layer of free fibres extending on each side of the core 11.

The free fibres 13 are disposed in planes that are interposed with respect to the planes containing the spikes 12.

In order to produce the applicator member 10, first of all the core 11 is moulded from polymer material together with the first application elements 12, namely in this case the spikes, and with the second application elements 13, in this case the free fibres. The core 11 with the first application elements 12 is advantageously overmoulded on the second application elements 13, in this case the free fibres, preferably positioned parallel to one another, as illustrated in the figures. Generally, first and second application elements 12, 13 are obtained that are inseparable from the core 11 so as to form an application assembly in one piece with the core 11.

Figure 5:
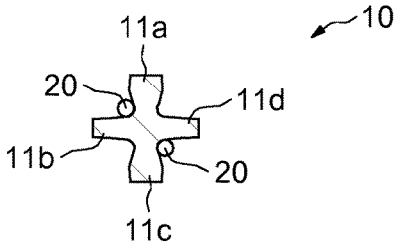
FIG. 5 illustrates a view in cross section of the applicator member in FIG. 2 at the end of the core after the support has been fitted on the core and before said support is twisted.
Figure 6:
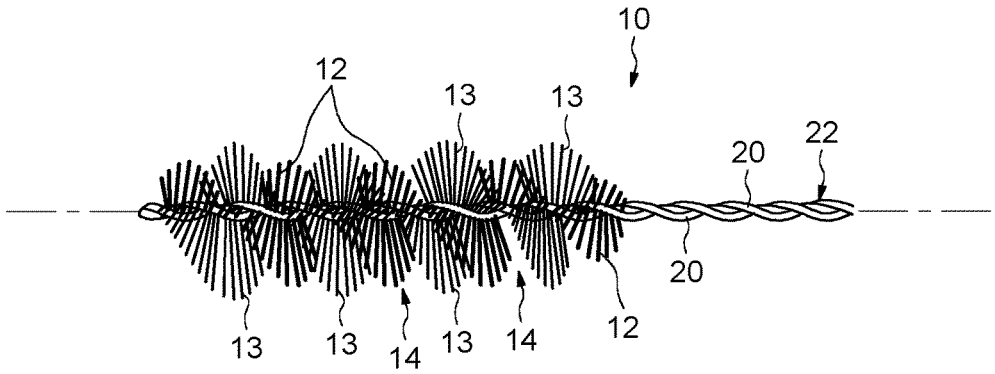
FIG. 6 is a perspective view of the applicator member in FIG. 4 after the support has been fitted on the core and said support has been twisted.

This application assembly is then disposed between two arms 20 of a support 22, visible in FIGS. 5 and 6. The support 22 initially has, before twisting, for example the form of a U-shaped hairpin, and is made for example of metal material.

A first arm 20 of the U-shaped hairpin is threaded between a first rib 11*a* and a second rib 11*b* of the core 11, and a second arm 20 of the U-shaped hairpin is threaded between a third rib 11*c* and a fourth rib 11*d* of the core 11, as can be seen in FIG. 5. Generally, the first arm of the hairpin is threaded between two adjacent ribs and the second arm of the hairpin is threaded between two adjacent ribs symmetrically with respect to the first arm of the hairpin.

A twisting force is then applied to said support 22 in order to form a twisted application assembly comprising the core bearing the intertwined spikes 12 and free fibres 13, as can be seen in FIG. 6. The twisting of the arms 20 of the support 22 twists the core 11 about its longitudinal axis and allows these two types of application element 12, 13 to spread helically, which elements take up an interposed distribution in helical layers, as can be seen in FIG. 6.

It makes no difference whether twisting is carried out in one twisting direction or in the other.

The application assembly may turn through more than one revolution on itself about its longitudinal axis under the effect of the twist imparted by the arms 20 of the support 22, forming an alternate succession of helical coils along the longitudinal axis of the core, each containing the first or the second application elements.

In other words, an alternation of the first and second application elements in the longitudinal direction of the applicator member is obtained.

Figure 7:
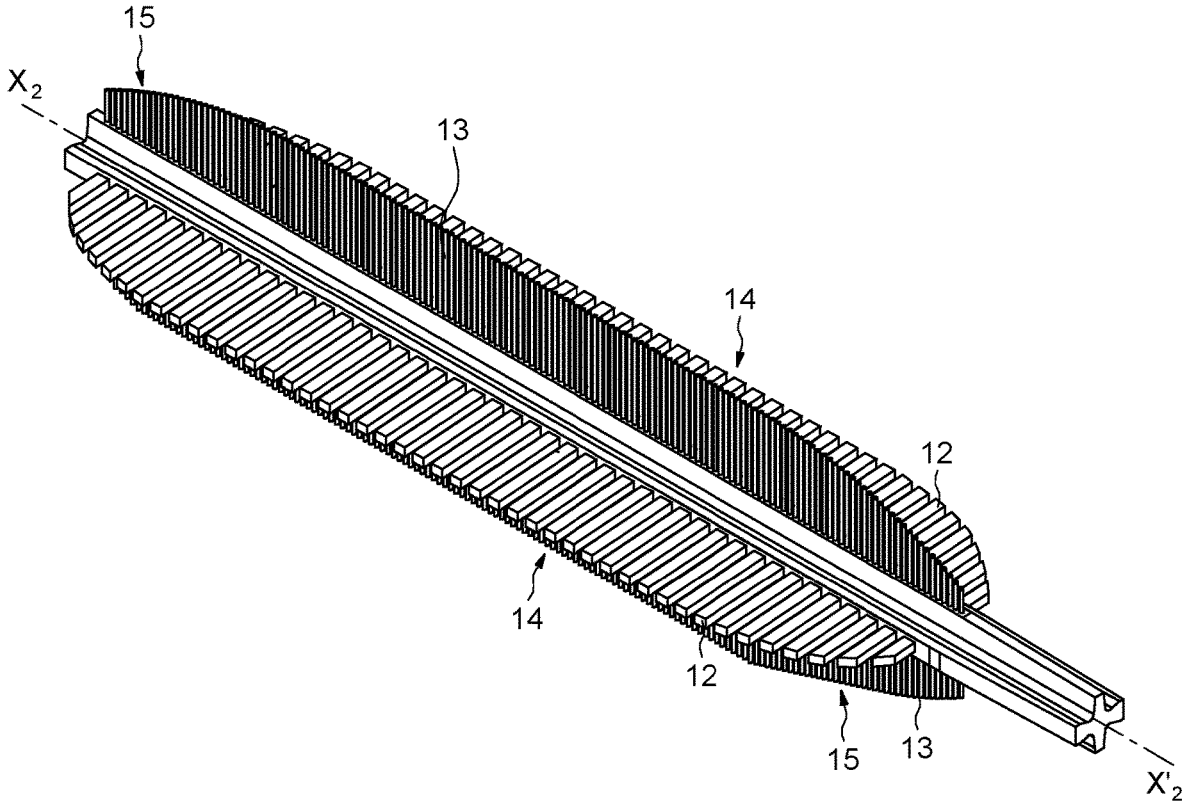
FIG. 7 shows a perspective view, on its own, of an applicator member of the applicator in FIG. 1 according to a second exemplary embodiment of the invention, after the application elements have been shaped but before the support is fitted on the core.

The embodiment illustrated in FIG. 7 differs from the embodiment illustrated in FIGS. 2 to 6 only by the fact that the core 11 bears two diametrically opposed rows 14 of single spikes 12 moulded together with the core rather than double spikes. In this example, the core 11 likewise bears two diametrically opposed rows 15 of free fibres 13 as in the previous embodiment.

The height of the spikes 12, whether single or double, and of the free fibres 13, may decrease towards the free ends of the core 11. The shaping of the application elements 12, 13 is visible in FIG. 4. The shaping of the spikes 12 is advantageously carried out during the moulding of the core. The shaping of the free fibres 13 is carried out in particular by cutting the fibres.

Figure 8:
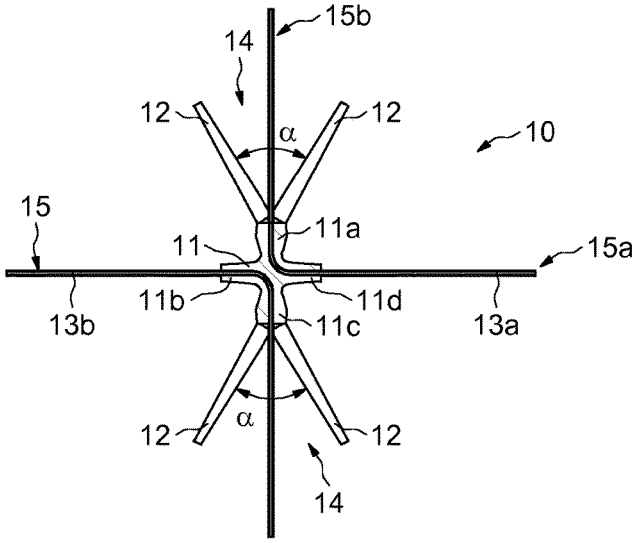
FIG. 8 is a view in section of an applicator member according to a third exemplary embodiment of the invention, before the application elements are shaped and before the support is fitted on the core.
Figure 9:
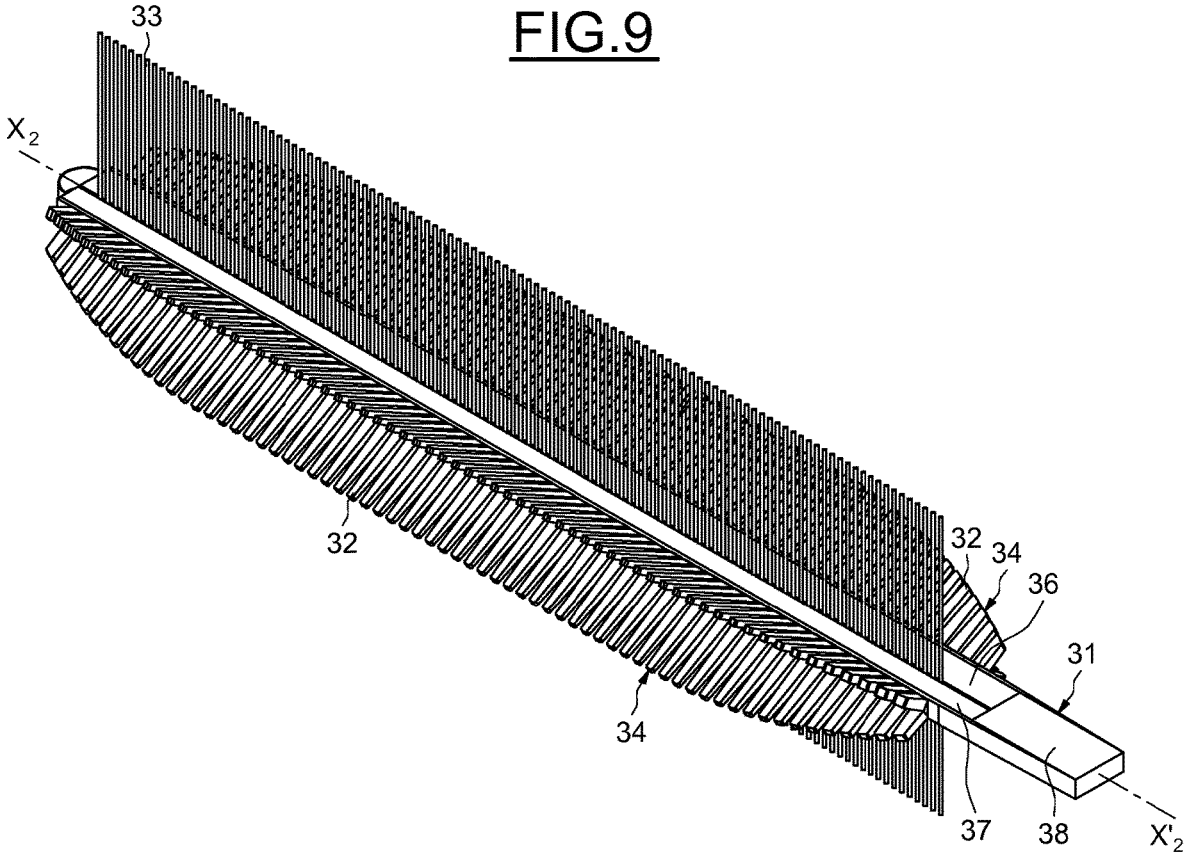
FIG. 9 shows a perspective view, on its own, of an applicator member of the applicator in FIG. 1 according to a fourth exemplary embodiment of the invention, before the application elements are shaped and before the support is fitted on the core.
Figure 10:
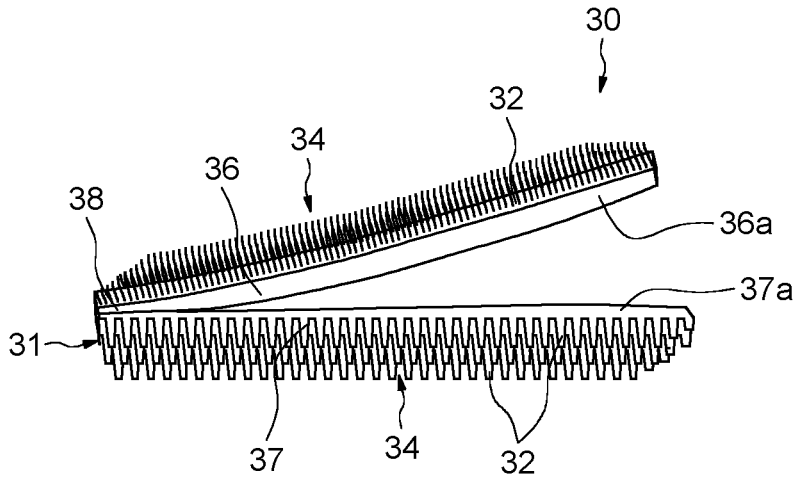
FIG. 10 illustrates a step in the manufacture of the applicator member in FIG. 9.

The embodiment illustrated in FIG. 8 differs from the embodiment illustrated in FIGS. 2 to 6 only by the fact that the core 11 bears two layers of free fibres 13*a*, 13*b* rather than one.

Each fibre layer 13*a*, 13*b* is curved at the centre of the core 11 and comprises a first part extending from a first rib 11*a*; 11*b* of the core and a second part extending from an adjacent second rib 11*d*; 11*c* of the core.

Thus, the core 11 bears four rows 15*a*, 15*b*, diametrically opposed in pairs, of free fibres 13*a*, 13*b* moulded together with the core.

The core 11 likewise bears two diametrically opposed rows 14 of double spikes 12. In this example, one of the ends of the fibre layers 13*a*, 13*b* extends between two arms of a double spike.

In a variant, single spikes could be provided.

FIGS. 9 to 12 illustrate another embodiment of an applicator member 30.

The applicator member 30 has an elongate main body or core 31, first application elements 32 and second application elements 33.

The core 31 is made of polymer material, notably thermoplastic material, having the first application elements or spikes 32 that are moulded together with the core 31 and extend radially from the core 31 and all around the latter. The spikes 32 may be aligned with one another in at least one row, which extends axially for example along more or less the entire length of the core 31.

Figure 11:
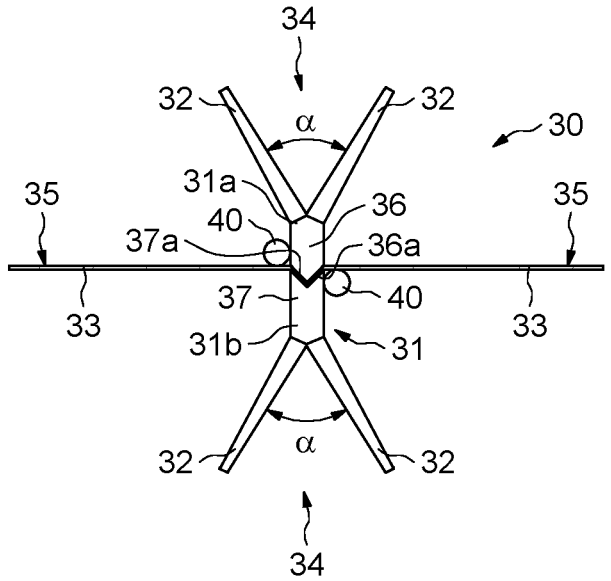
FIG. 11 is a view in section of the applicator member in FIG. 9 after the support has been fitted on the core and before said support is twisted.

As can be seen in FIG. 11, the core 31 has, in cross section, a shape with two ribs 31*a*, 31*b* that meet at the centre of the core 31. In the example illustrated in FIGS. 9 to 12, the core 31 bears two diametrically opposed rows 34 of double spikes 32. Each double spike 32 has two arms which diverge with increasing distance from the longitudinal axis of the core 31, at an angle $\alpha$, for example equal to 60°.

The arms of a single double spike 32 meet at the top of the corresponding rib 31*a*, 31*b* of the core 31. The spikes 32 form first application elements that are particularly suitable for combing/separating the eyelashes during the application of the product. The core 31 also bears two diametrically opposed rows 35 of free fibres 33 or bristles, made for example of nylon, that form second application elements that are particularly suitable for loading with the product to be applied.

The free fibres 33 are disposed in planes that are interposed with respect to the planes containing the spikes 32.

In the example illustrated in FIGS. 9 to 12, the core 31 comprises two parts 36, 37 that are connected at one of their ends by material forming a hinge 38 hinged along an axis perpendicular to the longitudinal axis X2-X2' of the core 11. Thus, the two parts 36, 37 act as a jaw that is hinged between an opened position, visible in FIG. 10, in which the free fibres 33 are positioned substantially adjacently, and preferably parallel, to one another, and a closed position, visible in FIGS. 9 and 11, in which the free fibres 33 are pinched between the two parts 36, 37 of the core 31.

Each of the parts 36, 37 bears, on its outer surface, double spikes 32. In a variant, single spikes could be provided.

One of the parts 36 comprises, on its inner surface, opposite the outer surface, a longitudinal rib 36*a* that extends from the free end of said part 36 towards the hinge 38 and cooperates with a corresponding longitudinal groove 37*a* in the second part 37. The groove 37*a* extends from the free end of said second part 37 towards the hinge 38.

In order to produce the applicator member 30, first of all the core 31 is moulded from polymer material together with the first application elements 32, namely in this case the spikes. Next, the free fibres 33 are disposed in tufts or bunches between the parts 36, 37 of the core 31, substantially adjacently, and preferably parallel, to one another, and then the core 31 is hinged into the closed position, visible in FIGS. 9 and 11, so as to pinch the free fibres 33 between the two parts 36, 37 of the core 31.

In a similar manner to the embodiments illustrated in FIGS. 2 to 7, first and second application elements are obtained that are inseparable from the core so as to form a one-piece application assembly.

Figure 12:
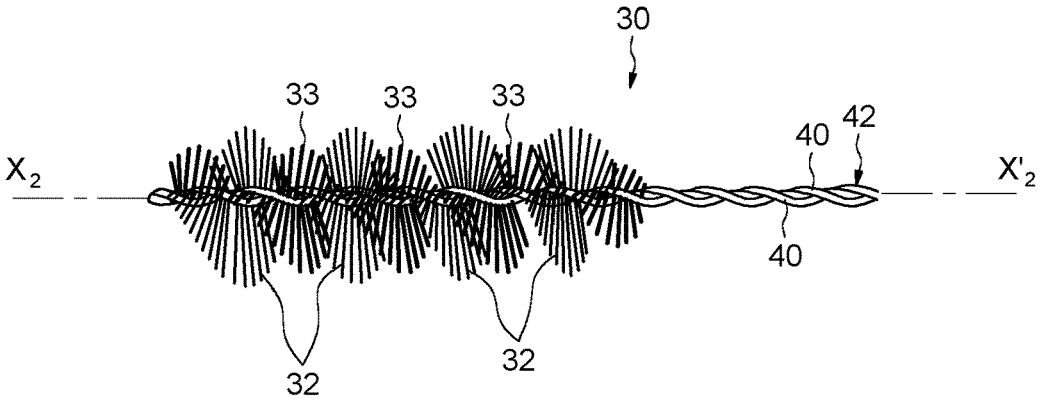
FIG. 12 is a perspective view of the applicator member in FIG. 9 after the application elements have been shaped, after the support has been fitted on the core and said support has been twisted.

This application assembly is then disposed between two arms 40 of a support 42, visible in FIGS. 11 and 12. The support 42 initially has, before twisting, for example the form of a U-shaped hairpin, and is made for example of metal material.

A first arm 40 of the U-shaped hairpin is threaded between a first rib 31*a* of the core 11 and the layer of free fibres 33, and a second arm 20 of the U-shaped hairpin is threaded between a second rib 31*b* and the layer of free fibres 33, on the opposite side from the first arm 40 of the hairpin, as can be seen in FIG. 11. Generally, each of the arms of the hairpin is threaded symmetrically between a rib and the adjacent layer of free fibres.

A twisting force is then applied to said support 42 in order to form a twisted application assembly comprising the core 31 bearing the intertwined spikes 32 and free fibres 33, as can be seen in FIG. 12. The twisting of the arms 40 of the support 42 twists the core 31 about its longitudinal axis and allows these two types of application element 32, 33 to spread helically, which elements take up an interposed distribution in helical layers, as can be seen in FIG. 12. It makes no difference whether twisting is carried out in one twisting direction or in the other. However, in this exemplary embodiment, twisting is preferably carried out in a direction such that the arms 40 of the hairpin are deformed in the direction of the adjacent ribs 31*a*, 31*b* of the core while the support is being twisted. Thus, in the exemplary embodiment illustrated in FIG. 9, the twisting of the hairpins 40 of the support 42 is preferably carried out in the clockwise direction.

The application assembly may turn through more than one revolution on itself about its longitudinal axis under the effect of the twist imparted by the arms 40 of the support 42, forming an alternate succession of helical coils along the longitudinal axis of the core, each containing the first or the second application elements.

In other words, an alternation of the first and second application elements 32, 33 in the longitudinal direction of the applicator member 30 is obtained.

In all the embodiments, the free fibres or bristles 13, 33 may all be identical to one another, or indeed be formed from a collection of bunches of different types of bristle, for example with different diameters, shapes and cross sections. The bristles are made, for example, of synthetic or natural material, notably of polyamide.

In this embodiment, provision could be made for the internal surfaces of the two parts 36, 37 to comprise notches (not shown) configured to make it possible to position the free fibres 33 before the parts are hinged into the closed position. Thus, a free fibre 33 may be disposed in a plane between two planes that each contain a spike 32.

Figure 13:
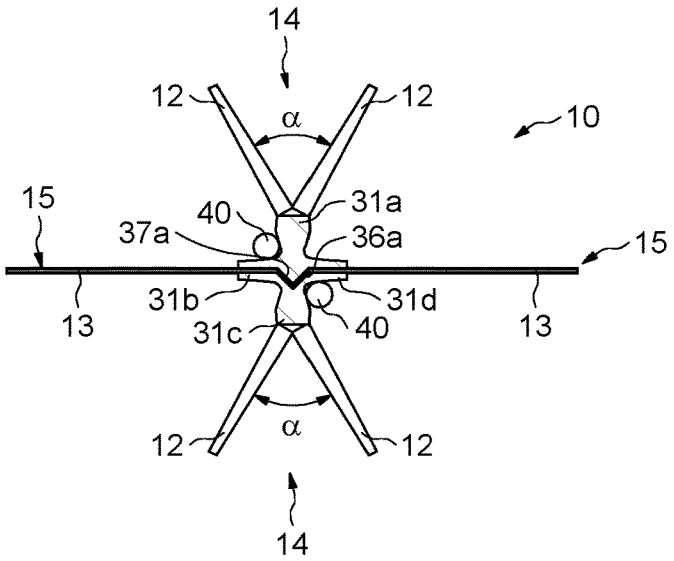
FIG. 13 is a view in section of the applicator member according to another embodiment after the support has been fitted on the core and before said support is twisted.

The embodiment illustrated in FIG. 13 differs from the embodiment illustrated in FIGS. 9 to 12 only by the fact that the core 11 has, in cross section, a cross shape with four ribs 31*a*, 31*b*, 31*c*, 31*d*, opposite one another in pairs, that meet at the centre of the core 31. The addition of ribs makes it possible to improve the hold of the free fibres 33.

In the embodiment in FIG. 13, each part 36, 37 of the core 31 comprises a central rib 31*a*, 31*c* and two lateral half-ribs suitable for cooperating with the two lateral half-ribs provided on the other part 37, 36 so as to form two lateral ribs 31*b*, 31*d* that pinch the free fibres 13.

In this embodiment, the arms of the hairpin 40 of the support 42, before twisting, are threaded respectively between two adjacent ribs symmetrically with respect to one another.

By way of indication, in order to mould the second application elements on the core, use can be made of any synthetic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA.

By virtue of the invention, an applicator of simple and economic design that is easy to assemble is provided, with an alternation of free fibres or bristles and spikes.

In addition, the free fibres or bristles are held securely with the core made of thermoplastic material.

The invention claimed is:

1. An applicator member for applying a product to keratin fibers or eyelashes, the applicator member comprising:

a core comprised of a polymer material and extending along a longitudinal axis;

first application elements that project from the core and are integral with the core; and second application elements that project from the core and are separate from the first application elements;

wherein the core, the first application elements, and the second application elements form a one-piece assembly, wherein the first and second application elements are arranged in at least two helical coils disposed alternately along the longitudinal axis of the core, wherein the applicator comprises a support deprived of any application elements and comprising at least two arms that are twisted at least partially together, the one-piece assembly bearing the first and second application elements being retained between the arms and turning through more than one revolution on itself about its longitudinal axis under the twisting effect brought about by the arms of the support, and wherein the first application elements are spikes and the second application elements are free fibers or bristles, wherein the core is overmoulded on the second application elements, or wherein the core comprises two complementary parts that are connected at one of their ends by material forming a hinge and are hinged along an axis perpendicular to the longitudinal axis of the core, between an opened position and a closed position in which the second application elements are pinched between the two parts of the core.

2. The applicator member of claim 1, wherein a helical coil of the first application elements is disposed between a helical coil of the second application elements.

3. The applicator member of claim 1, wherein each of the complementary parts bears, on its outer surface, the first application elements.

4. The applicator member of claim 1, wherein a first of the complementary parts of the core comprises, on an inner surface, a longitudinal rib that extends from a free end of the first of the complementary parts toward the hinge and cooperates with a corresponding longitudinal groove in a second of the complementary parts, wherein the groove extends from the free end of the second of the complementary parts toward the hinge.

5. The applicator member of claim 1, wherein the core has, in cross section, a shape with at least two diametrically opposed ribs that meet at the center of the core.

6. A device for packaging and applying a product or a makeup product, the device comprising a container for storing the product, and an applicator comprising an applicator member according to claim 1, wherein the applicator member is configured to be inserted into the internal volume of the container to be loaded with the product.

7. A method for manufacturing the applicator member of claim 1, the method comprising:

forming a one-piece assembly with the core, the first application elements, and the second application elements;

disposing the one-piece assembly between two arms of a support, and deforming the core by applying a twisting force to the support to turn the one-piece assembly through more than one revolution on itself about its longitudinal axis to form an alternate succession of helical coils along the longitudinal axis of the core, each containing the first or the second application elements, and keeping the core in the deformed state.

* * * * *